US005233917A

United States Patent [19]

Handzlik

[11] Patent Number: 5,233,917

[45] Date of Patent: Aug. 10, 1993

[54] PLASTIC BOTTLE CRUSHING DEVICE

[76] Inventor: Walter A. Handzlik, 5710 Paradise Ridge Rd., West Bend, Wis. 53095

[21] Appl. No.: 951,134

[22] Filed: Sep. 25, 1992

[51] Int. Cl.[5] ..... B30B 7/04

[52] U.S. Cl. ..... 100/232; 100/233; 100/289; 100/902; 222/103

[58] Field of Search ..... 100/232, 236, 233, 264, 100/289, 902; 222/103; 241/99

[56] References Cited

U.S. PATENT DOCUMENTS

| | | | |
|---|---|---|---|
| 36,751 | 10/1862 | Briggs | 100/233 |
| 480,867 | 8/1892 | Estrayer | 100/232 X |
| 947,932 | 2/1910 | Peckham | 100/264 X |
| 1,417,610 | 5/1922 | Kruse | 100/232 X |
| 1,464,829 | 8/1923 | Rancadore et al. | 100/233 |
| 1,966,338 | 7/1934 | Eggimann | 100/232 X |
| 2,073,473 | 3/1937 | Gay | 222/103 |
| 2,434,607 | 1/1948 | Carruthers | 100/232 X |
| 2,773,536 | 12/1956 | Lange | 100/264 |
| 3,901,141 | 8/1975 | Bochmann | 100/264 X |
| 4,475,449 | 10/1984 | Gianelo | 100/232 X |
| 4,989,743 | 2/1991 | Lowery | 222/103 X |

FOREIGN PATENT DOCUMENTS

| | | | |
|---|---|---|---|
| 283320 | 4/1915 | Fed. Rep. of Germany | 100/232 |
| 82772 | 11/1953 | Norway | 100/264 |
| 62 | 1/1857 | United Kingdom | 100/232 |
| 722278 | 1/1955 | United Kingdom | 100/232 |

*Primary Examiner*—Stephen F. Gerrity
*Attorney, Agent, or Firm*—Andrus, Sceales, Starke & Sawall

[57] ABSTRACT

A plastic bottle crushing device that crushes the side of a bottle in two directions at the same time. The device includes a hollow housing surrounding the plastic bottle which includes a pair of opposite spaced apart crushing members movable between an open position and a closed position that converge toward each other in a first direction. Folding panels hinged to each other and to the edges of the crushing plates move simultaneously with the crushing plates between open and closed positions to converge inwardly in a second squeezing direction which is perpendicular to the first crushing direction. Gear driven threaded members are utilized to drive the crushing plates and squeezing panels between their respective open and closed positions.

6 Claims, 2 Drawing Sheets

FIG. 1
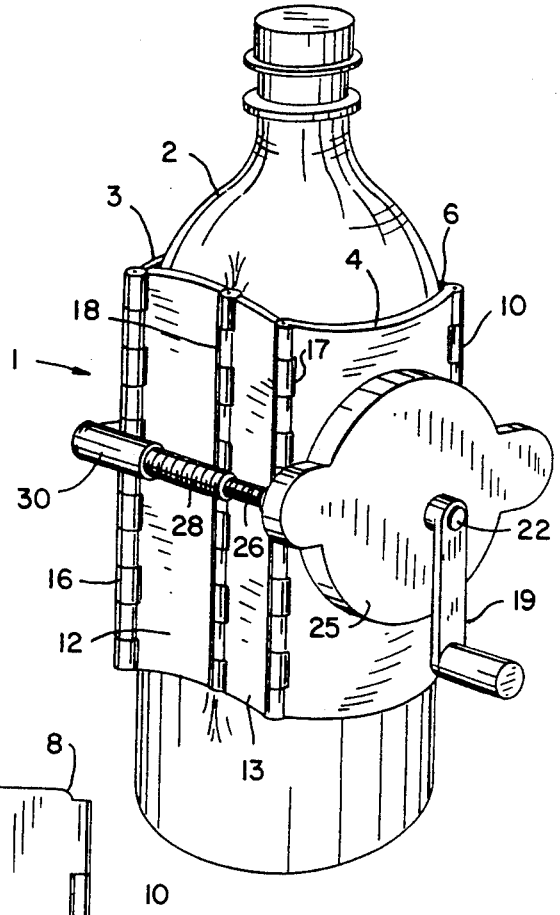
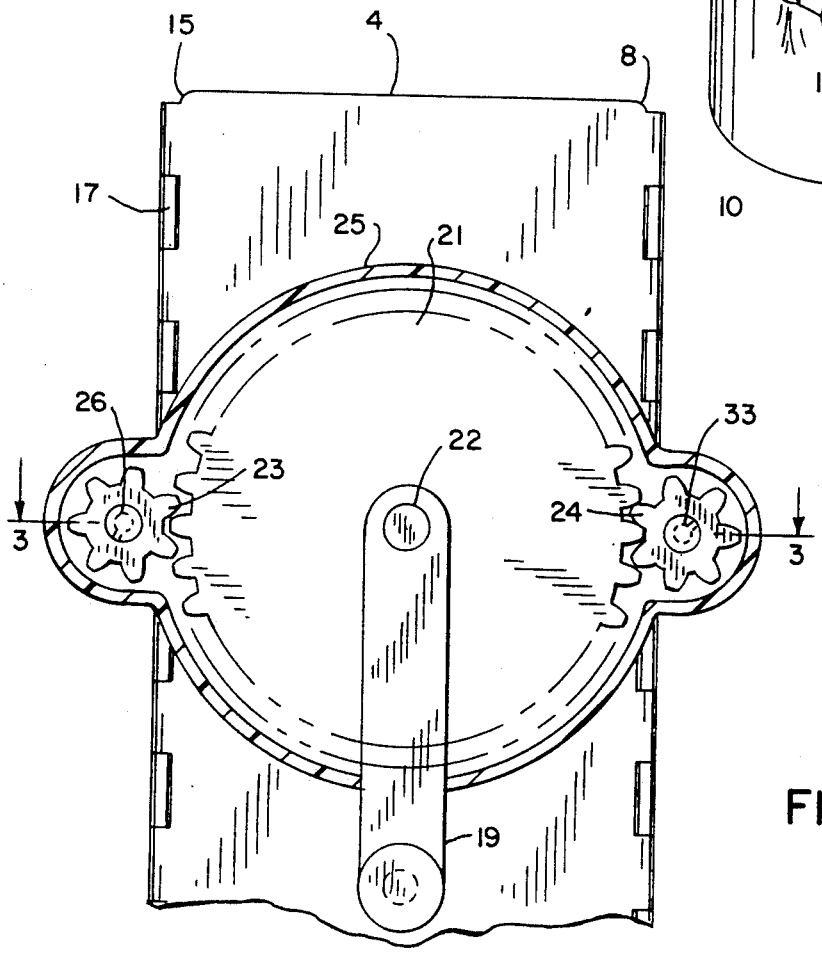
FIG. 2

PLASTIC BOTTLE CRUSHING DEVICE

BACKGROUND OF THE INVENTION

The present invention relates to crushing devices, and more particularly to an improved plastic bottle crushing apparatus which is manually operated and capable of crushing commercially available plastic beverage bottles or the like of all sizes in a quick and efficient manner.

Plastic beverage containers present several problems in today's ecology minded society. One of these problems involves disposal. It is clearly desirable to recycle such beverage containers but such recycling requires temporary storage until the containers can be taken to a recycling center. Containers such as two-liter bottles take up a large storage volume and therefore various crushing devices have been suggested to reduce container storage volume. Generally, these crushing devices are large hydraulically operated crushers, and as such cannot be utilized by homeowners.

Another problem involving plastic beverage containers, especially those of larger volume, is that a carbonated beverage typically occupies only a portion of the volume of the container and tends to go "flat" due to the tendency of the carbonated gases to achieve equal pressure level to that of the air above the liquid within the container. The usual recapping of a once opened container and its subsequent storage further diminishes the carbonation in the beverage since as the liquid volume to air volume ratio decreases the carbonated gases within the beverage continuously escape into the air above the liquid in the container. As a result, subsequent pourings of the beverage from the container are noticeably flat. It is therefore desirable to provide a device that could be used to prevent the carbonated beverage within the container from going flat or losing its "fizz".

SUMMARY OF THE INVENTION

The present invention provides a device for crushing plastic bottles or containers to prevent any beverage contained therein from going flat, and once empty, to reduce the bottle's volume so it can be more easily stored for disposal. The device provides an apparatus that crushes the sides of the bottles in two directions at the same time. The invention thus provides a crusher which is portable, simple, efficient in operation and economical to manufacture. The liquid is kept from going flat by compressing the bottle after a pouring thus making the bottle smaller thereby raising the level of liquid back up into the neck of the bottle leaving very little air over the liquid into which carbon dioxide can escape.

In order to accomplish the above, the plastic bottle crushing device of the present invention comprises a hollow housing having an open top and an open bottom defining a bottle receiving opening. The housing provides crushing means including a pair of opposite spaced apart crushing plates movable between an open position and a closed position wherein the plates converge toward each other in a first direction, and squeezing means including opposite spaced apart squeezing members interconnected with the crushing plates for movement simultaneously with the crushing plates between open and closed positions in a second squeezing direction which is perpendicular to the first crushing direction. A driving means is employed for moving the crushing plates and squeezing members between their respective open and closed positions.

The squeezing members interconnect opposite edges of the crushing plates, and are preferably comprised of a pair of folding panels which are hingedly connected to each other and to the edges of the crushing plates. The panels are preferably arcuate shaped to form a concave surface curving into the interior of the hollow housing. The crushing plates are also preferably arcuate shaped, but in contrast to the squeezing panels are disposed in a convex manner. These arcuate shapes enable the forces to be evenly distributed over the area of the crushing plates and squeezing members during a crushing operation. These shapes also enable ready release of the device from a crushed bottle. Accordingly, in a crushing operation, the squeezing panels force opposite sides of a plastic bottle to collapse toward each other while at the same time the crushing plates compress the other sides of the bottle into a compact structure of less volume for ready storage and disposal.

BRIEF DESCRIPTION OF THE DRAWINGS

The drawings illustrate the best mode presently contemplated of carrying out the invention.

In the drawings:

FIG. 1 is a side view in elevation of a crushing device constructed in accordance with the principles of the present invention;

FIG. 2 is an end view illustrating a hand operated gear drive for the apparatus;

DESCRIPTION OF THE PREFERRED EMBODIMENT

Figure 3:
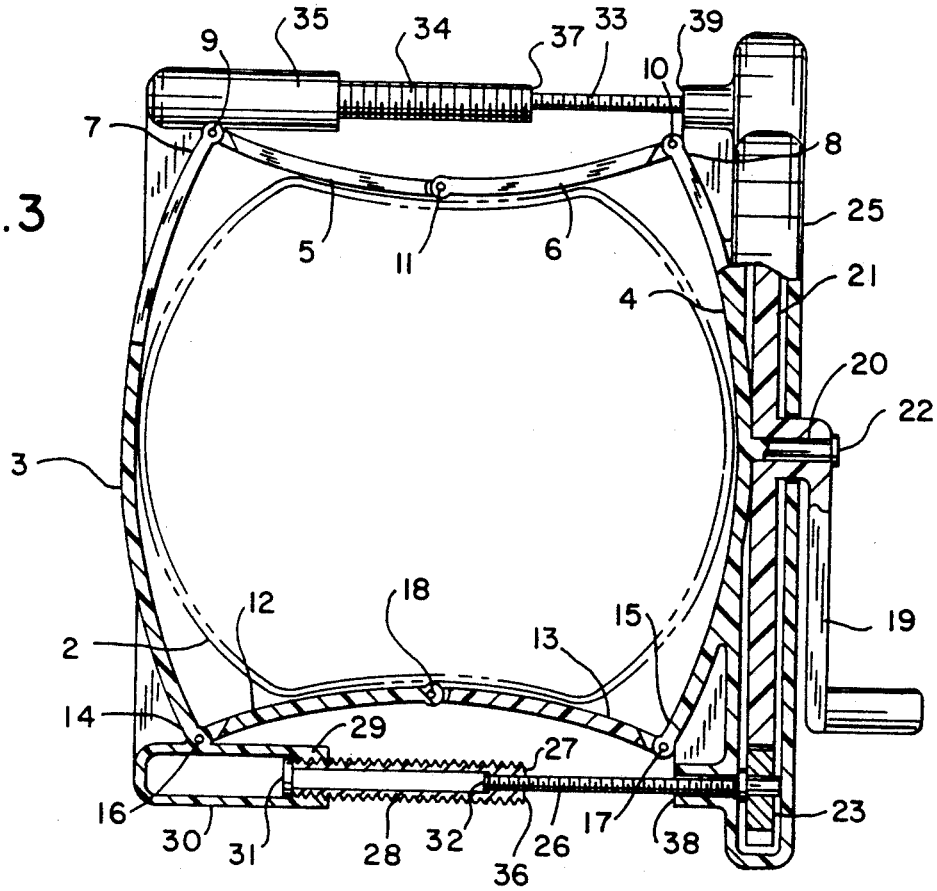
FIG. 3 is a cross-sectional view taken along the plane of the line 3—3 in FIG. 2 with a plastic bottle shown in phantom and just after an initial crushing operation begins.

Referring now to the drawings, FIG. 1 illustrates a crushing device generally designated by the numeral 1 for crushing a plastic bottle 2. As illustrated, bottle 2 is a commercially available beverage container having a two liter volume. It should readily be apparent that crushing device 1 may be employed with other plastic containers of varying volume and is thus not limited to the crushing of only two liter style plastic bottles.

Crushing device 1 comprises a hollow housing having an open top and an open bottom that surrounds bottle 2 and defines a bottle receiving opening therein. As shown best in FIGS. 1 and 3, the housing which defines device 1 includes crushing means for compressing opposite sides of bottle 2 together with squeezing means for compressing the remaining two opposite sides of bottle 2 in a direction perpendicular to the movement of the crushing means. More specifically, the crushing means includes a pair of opposite spaced apart crushing plates 3 and 4 that are movable between an open position shown in FIG. 3 and a closed position shown in FIG. 4 wherein the crushing plates 3, 4 engage against bottle 2 and converge inwardly toward each other in a first direction during a crushing operation. Crushing plates 3, 4 are each substantially rectangular in shape and may be composed of a rigid molded plastics material, metal or a combination of both. Preferably, plates 3 and 4 are a rigid molded plastic material. As shown best in FIGS. 1 and 3, plates 3 and 4 are arcuate in shape, and are positioned in a convex manner with respect to the bottle receiving opening around the sides of bottle 2. This arcuate shape functions to distribute the forces over a wider area of plates 3 and 4 than if plates 3 and 4 were flat or planar in shape. Thus, plates 3 and 4 are less likely to crack, snap or break during a crushing operation. The arcuate shape of plates 3 and 4 also functions to provide easy release from the sides of bottle 2 after a completed crushing operation since this shape avoids the possibility of "catching" or "snagging" on bottle 2.

Figure 4:
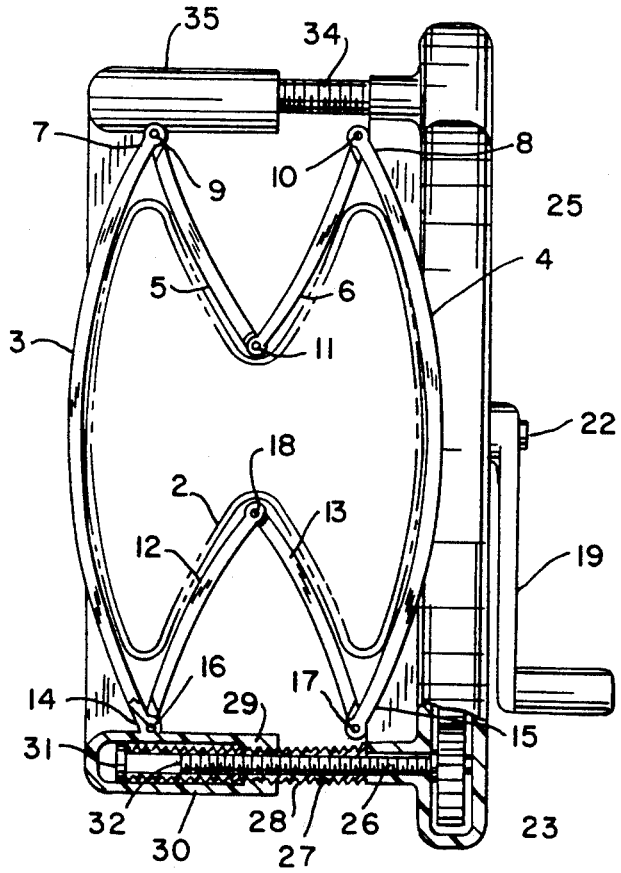
FIG. 4 is a view similar to FIG. 3 with certain parts broken away and in cross-section illustrating a completed crushing operation.

The squeezing means acts simultaneously with the crushing means, but in a direction perpendicular thereto. The squeezing means acts on the remaining two opposite sides of bottle 2 and moves simultaneously in response to the movement of crushing plates 3 and 4 between an open position shown in FIG. 3 and a closed position shown in FIG. 4. The squeezing means includes two pairs of squeezing members or folding panels each interconnecting matching vertical edges of crushing plates 3 and 4. As shown best in FIGS. 3 and 4, a first pair of squeezing members or panels 5 and 6 are disposed between plates 3 and 4 and extend between edge 7 of plate 3 and edge 8 of plate 4. As shown, each panel 5 and 6 is substantially rectangular in shape and composed of a rigid molded plastic material, metal or a combination of both. Preferably, panels 5 and 6 are composed of a rigid plastic material identical to that of plates 3 and 4. Panel 5 is pivotally connected to plate 3 by a hinge 9 while panel 6 is pivotally connected to plate 4 by hinge 10. In addition, panels 5 and 6 are pivotally connected to each other by a third hinge 11. As a result, as crushing plates 3 and 4 converge inwardly toward each other panels 5 and 6 will pivot in response to this movement inwardly as shown in FIG. 4 to compress the sides of bottle 2 in a direction perpendicular to the direction of movement of plates 3 and 4.

The identical squeezing arrangement is provided by panels 12 and 13 which are disposed between edges 14 and 15 of crushing plates 3 and 4 respectively. Panel 12 is pivotally connected to plate 3 by means of hinge 16 and panel 13 is pivotally connected to plate 4 by means of hinge 17. As with panels 5 and 6, panels 12 and 13 are also pivotally connected to each other by means of hinge 18. Thus, during a crushing operation, as crushing plates 3 and 4 converge inwardly toward each other squeezing panels 5, 6, 12 and 13 will also be converging toward each other in a second direction perpendicular to the direction of movement of crushing plates 3 and 4. Squeezing panels 5, 6, 12 and 13 thus provide a mechanism for collapsing opposite sides of bottle 2 while at the same time crushing plates 3 and 4 act to crush the remaining sides of bottle 2 in order to provide a compact bottle of reduced volume. As illustrated in FIGS. 3 and 4, panels 5, 6, 12 and 13 form arcuate shaped walls that are disposed in a concave manner with respect to bottle 2. Thus, the forces developed during a crushing operation are distributed over the entire area of panels 5, 6, 12 and 13 to aid in preventing cracking, breaking or snapping of these members. Also, this concave shape enables panels 5, 6, 12 and 13 to be readily released from the sides of bottle 2 after a crushing operation to avoid being "caught" or "snagged" by the crushed bottle 2, as best shown in FIG. 4. Finally, this concave shape insures that panels 5 and 6 as well as panels 12 and 13 always converge inwardly, and not outwardly, during a crushing operation.

As a means for driving or moving the crushing plates 3, 4 and squeezing panels 5, 6, 12 and 13 between their respective open and closed positions, there is provided a hand operated driving mechanism. Although illustrated as being hand operated, it is readily apparent that the driving mechanism could be motorized if desired. As shown best in FIGS. 2–4, the driving mechanism includes a hand crank 19 connected by a shaft 20 to a sun gear 21. As shown in FIG. 3, shaft 20 may be an integrally molded part of crushing plate 4 which is peened over at 22 for mounting hand crank 19 thereon. As shown best in FIG. 2, the teeth of sun gear 21 engage the teeth of two pinion gears 23 and 24 which are each mounted for rotation in a housing 25 integrally projecting from crushing plate 4.

Referring now to pinion gear 23, pinion 23 is integrally connected to a screw 26 having external threads. The threads of screw 26 engage an internally threaded portion 27 of a hollow, tubular threaded member 28. Member 28 in turn also has external threads which engage an internally threaded portion 29 of a hollow tubular housing 30. Tubular housing 30 is rigidly mounted on crushing plate 3, and as best shown in FIG. 1, housing 30, threaded member 28 and screw 26 extend substantially horizontally between crushing plates 3 and 4. Threaded member 29 includes a flange 31 at one end for engagement with portion 29 of housing 30 to prevent it from being turned completely out of housing 30. Likewise, screw 26 includes a flange 32 at one end engageable with portion 27 of member 28 to prevent it from being completely out of member 28. It should be noted that pinion 24 is also connected via a screw 33, threaded member 34 and tubular housing 35 in the identical manner, and therefore need not be further described herein.

In operation, when crank 19 is turned in a clockwise direction, pinion gears 23 and 24 will both be rotated in a counterclockwise direction as will screws 26 and 33. As screws 26 and 33 are rotated, their threads engage the internal threads of portions 27 and 29 respectively to pull crushing plate 3 towards crushing plate 4 which simultaneously will also cause squeezing panels 5, 6, 12 and 13 to begin to be moved inwardly. As crank 19 continues to be turned in a clockwise direction, plate 3 will continue to be pulled towards plate 4 until edges 36 and 37 of threaded members 28 and 34 respectively engage or abut against edges 38 and 39 of housing 25, as shown in FIG. 4. Thereafter, as crank 9 is continued to be rotated in its clockwise direction, friction causes threaded members 28 and 34 to now begin to rotate, and as they rotate will be turned down into tubular housings 30 and 35 respectively. This action continues the crushing operation and forces crushing plates 3 and 4 as well as squeezing panels 5, 6, 12 and 13 closer together toward their closed positions in order to compress bottle 2, substantially as shown in FIG. 4. Eventually, threaded members 28 and 34 bottom out within tubular housings 30 and 35 at which time the crushing operation is complete. In order to release the device 1 from the now crushed bottle 2, the reverse operation is performed i.e. crank 19 is rotated in a counterclockwise direction. This will move plates 3 and 4 as well as panels 5, 6, 12 and 13 away from each other to release crushed bottle 2. The reverse or releasing operation is continued until the device is substantially back to its original starting position of FIG. 3. The crushed bottle 2 may now be removed and stored for recycling.

Various modes of carrying out the invention are contemplated as being within the scope of the following claims particularly pointing out and distinctly claiming the subject matter regarded as the invention.

I claim:

1. A device for crushing plastic bottles, comprising:

a hollow housing having an open top and an open bottom defining a bottle receiving opening, said housing comprising crushing means including a pair of opposite spaced apart crushing members reciprocally movable along a first axis between an open position and a closed position wherein said crushing members converge toward each other along said first axis when moving from said open position to said closed position for crushing a plastic bottle therebetween, each of said crushing members comprises a rectangular shaped plate, and squeezing means including opposite spaced apart squeezing members interconnected with said crushing members, said squeezing members responsive to the movement of said crushing members to reciprocally move simultaneously therewith along a second axis perpendicular to said first axis between an open position and a closed position wherein said squeezing members converge toward each other along said second axis when moving from said open position to said closed position, each of said squeezing members comprises a pair of inwardly folding panel members, and said panel members each having opposite first and second edges;

each of said squeezing members further including first means for pivotally connecting the first edges of said panel members to one another, second means for pivotally connecting the second edge of one of said panel members to one of said crushing members, and third means for pivotally connecting the second edge of the other of said panel members to the other of said crushing members; and drive means for moving said crushing members and squeezing members between their respective open and closed positions.

2. The device of claim 1, wherein said plate members are arcuate shaped, and are orientated in a convex manner with respect to said bottle receiving opening.

3. The device of claim 1, wherein each of said panel members are arcuate shaped, and are orientated in a concave manner with respect to said bottle receiving opening.

4. The device of claim 1, wherein said driving means comprises screw means interconnecting said crushing members and gear means for rotating said screw means.

5. The device of claim 4, wherein said each of said screw means comprises (a) a tubular housing mounted on one of said crushing members, said tubular housing having an internally threaded first portion, (b) a threaded member having external threads which are threadedly engaged with the internally threaded first portion of said tubular member, said threaded member including an internally threaded second portion adjacent one end thereof, and (c) a screw member mounted on the other of said crushing members having external threads which are threadedly engaged with the internally threaded second portion of said threaded member.

6. The device of claim 5, wherein said gear means comprises a pinion gear connected to each of said screw members for rotation therewith, a sun gear engageable with each of said pinion gears, and a crank for manually rotating said sun gear.

* * * * *